US005501045A

United States Patent [19]

Wexler

[11] Patent Number: 5,501,045

[45] Date of Patent: Mar. 26, 1996

[54] INTUMESCENT DOOR SEAL

[75] Inventor: Elias Wexler, Scarsdale, N.Y.

[73] Assignee: Zero International Inc., Bronx, N.Y.

[21] Appl. No.: 292,197

[22] Filed: Aug. 19, 1994

[51] Int. Cl.[6] ..... E04C 2/00

[52] U.S. Cl. ..... 52/232

[58] Field of Search ..... 52/232, 1, 393; 428/920; 49/483.1, 480.1, 489.1, 475.1

[56] References Cited

U.S. PATENT DOCUMENTS 4,931,339 6/1990 Malcom-Brown .

5,279,087 1/1994 Mann ..... 52/232

*Primary Examiner*—Creighton Smith

*Attorney, Agent, or Firm*—Fitzpatrick, Cella, Harper & Scinto

[57] ABSTRACT

An intumescent seal for doors, door frames or the like is provided which includes a first housing having a first outwardly opening channel formed therein and a second housing adjustably and movably mounted in the first outwardly opening channel of the first housing. The second housing also has an outwardly opening channel formed therein which is substantially filled with an intumescent material. The movable mounting of the second housing allows for resilient movement of the second housing within the first channel to ensure a tight seal.

10 Claims, 3 Drawing Sheets

FIG. 2
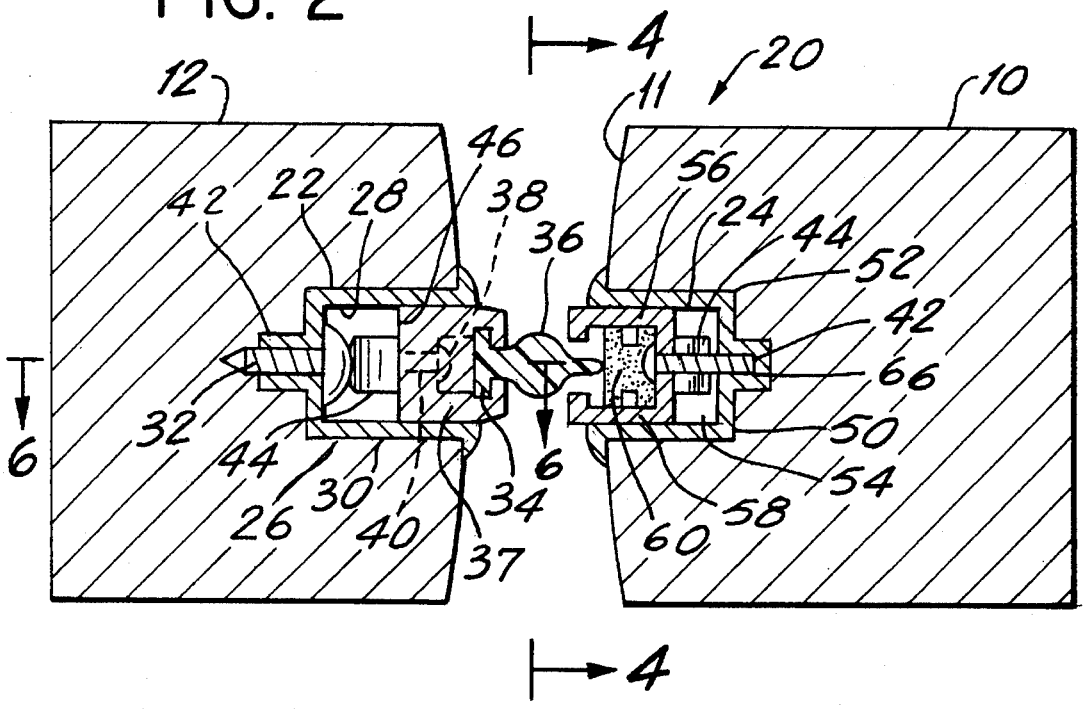
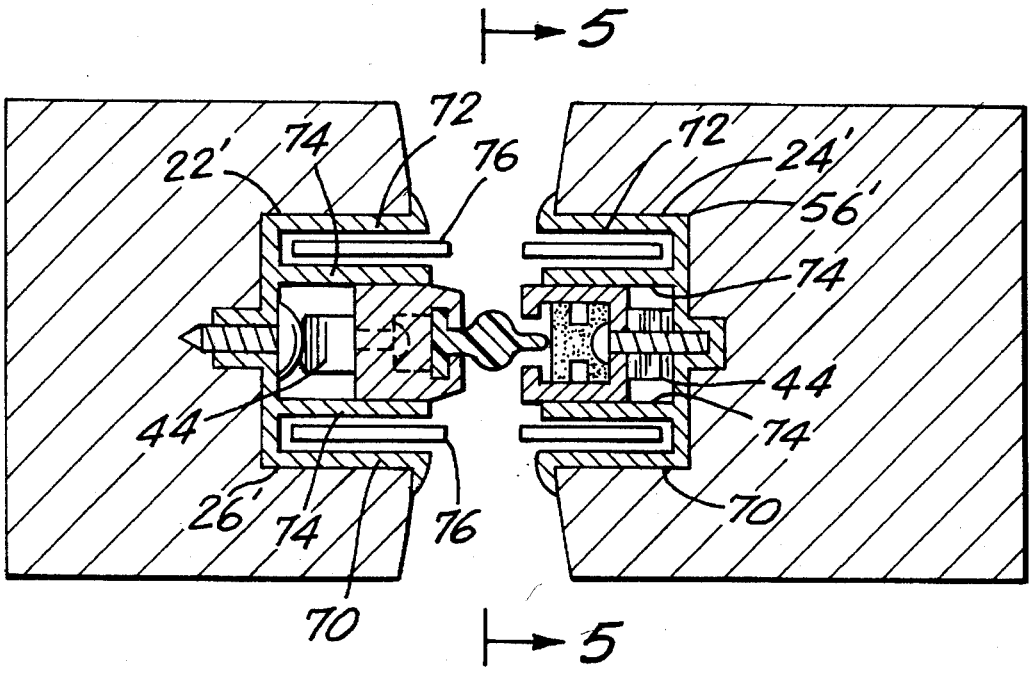
FIG. 3

INTUMESCENT DOOR SEAL

BACKGROUND OF THE INVENTION

The present invention relates to intumescent seals, and in particular to intumescent seals for doors, door frames or the like which are used to prevent dispersion of smoke, fumes and the like across the perimeter of the door or door frame during a fire.

Fire resistant seals using intumescent material have been previously proposed using intumescent materials which are well-known and which, when subjected to elevated temperature, undergo a substantial expansion to produce a foam of fire resistant material, often referred to as a "puff".

Previously proposed intumescent seals have been developed to seal the air space between doors and frames in the event of a fire. These seals are intended to prevent penetration by hot gases, smoke, heat and flames for several hours. Such previously proposed seals are disclosed, for example, in U.S. Pat. Nos. 4,045,930; 3,566,541; 4,660,338; 4,144,688; 4,246,304; 3,955,330; 4,733,514; and 4,649,089. These devices are relatively simple seals, which are secured in place in the door frame or the like. They are difficult to accurately align and, because of variability in expansion, will not form a perfect seal under all circumstances.

It is an object of the present invention to provide an improved intumescent seal.

Another object of the present invention is to provide an intumescent seal which is safe and efficient in operation.

Yet another object of the present invention is to provide an adjustable spring loaded intumescent seal.

A further object of the present invention is to provide an intumescent seal which is relatively simple in construction and which will assure proper sealing along the entire length of the seal.

In accordance with an aspect of the present invention a safe, efficient intumescent seal is provided which will prevent penetration across the seal of hot gases, smoke, heat and flames. The seal is preferably formed of a pair of the opposed first and second seal members, or seal means. Each seal member is adapted to be mounted within a channel or groove formed in the edge of a door and in the door frame. Each has an elongated generally channel-shaped housing member adapted to be mounted in a fixed position in the door or frame. The channel of the housing opens outwardly to face the opposed door or door frame. It contains a second housing or channel member that is adjustably mounted therein. The mounting is accomplished by a plurality of screws securing the second housing in the channel of the first housing. A leaf spring is mounted in the space between the housings to bias the second housing away from the first housing. Therefore, the second housing "floats" in the first housing.

In one of the seal means, the second housing is filled with an intumescent material. The second housing of the other seal member contains a flexible neoprene or rubber seal strip which is adapted to engage the intumescent material of its facing seal member when the door is shut, in normal operation, to provide an initial barrier to the penetration of smoke and gases, until the intumescent material expands.

The seal means of the invention are mounted in the frame of the door and the door itself. They may also be used in the opposed edges of a double door arrangement.

The assignee of the present application, Zero International Inc., manufactures and supplies the intumescent material used in accordance with the present invention. This material is provided as either a "soft puff" or "hard puff" material. Soft puff intumescent material will start to foam and expand at approximately 250° F. which will continue to expand with increase in heat. This product is offered by Zero under Nos. FS3003 and FS6886. A "hard puff" intumescent material expands all at once, once a particular temperature, say 450° F., is reached.

The above, and other objects, features and advantages of this invention will be apparent in the following detailed description of an illustrative embodiment thereof, which is to be read in connection with the accompanied drawings, wherein:

FIG. 2 is a sectional view taken along line 2—2 of FIG. 1 showing one embodiment of the invention;

FIG. 3 is a sectional view similar to FIG. 2 of another embodiment of the present invention;

Figure 1:
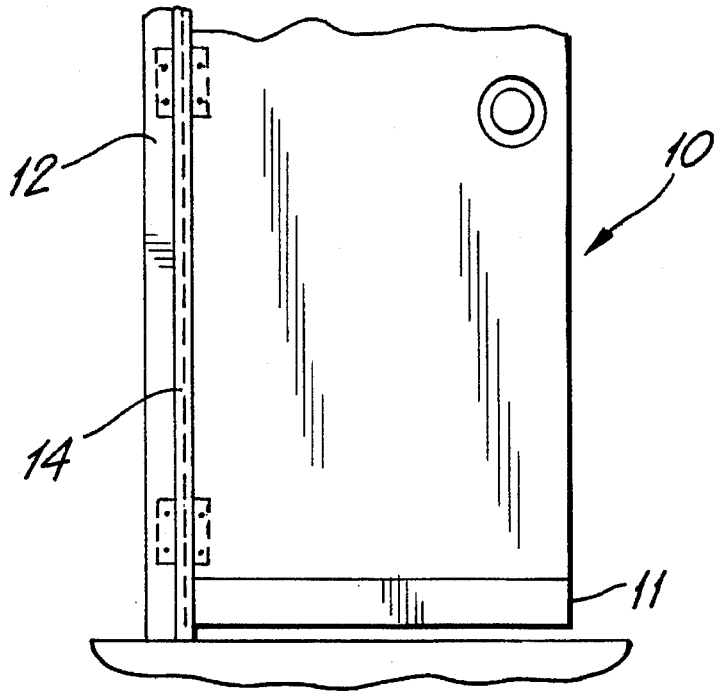
FIG. 1 is a plan view of a door containing an intumescent seal constructed in accordance with the present invention.
Figure 1A:
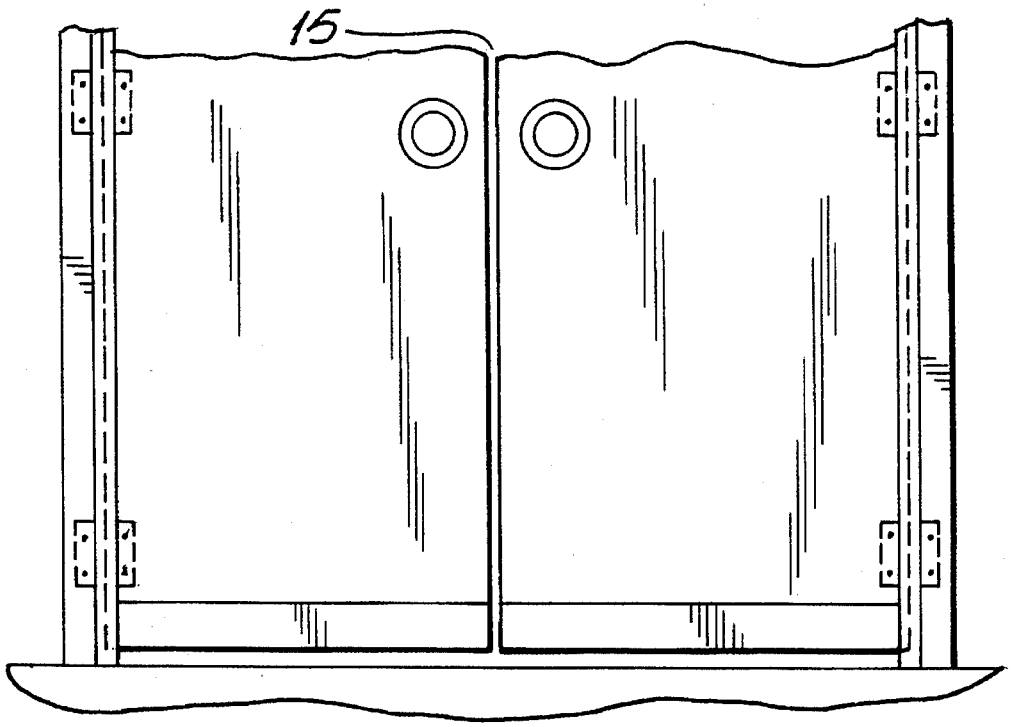
FIG. 1A is a plan view similar to FIG. 1 showing the use of the seal of the present invention in a double door arrangement.

Referring now to the drawings in detail, and initially to FIG. 1, a door 10 is schematically illustrated mounted in a frame 12. The door has a peripheral edge 11, in which one-half of the intumescent seal of the present invention is mounted. The other half is mounted in the facing sill or frame element of the doorway, as illustrated schematically by the dotted line 14 in FIG. 1. The seal of the invention may also be used in the facing edges 15 of a double door arrangement as shown in FIG. 1A.

One embodiment of the present invention is illustrated in FIG. 2. As seen therein the intumescent door seal 20 of the present invention comprises a first seal means 22 mounted in door frame 12, and a second seal means 24 mounted in the peripheral edge 11 of door 10.

First seal means 22 includes a first housing 26 which is an elongated generally channel-shaped member having an outwardly opening channel 28 formed therein. The housing or channel 26 is mounted in a groove 30 cut in frame 12 and is secured in the frame by a plurality of screws 32 positioned along the length of the channel.

Channel 28 receives a second housing member 37 therein. In the first seal means 22, as illustrated in FIG. 2, housing member 37 is an elongated bar having an undercut channel 34 formed therein which receives an elongated neoprene or rubber element 36.

Figure 6:
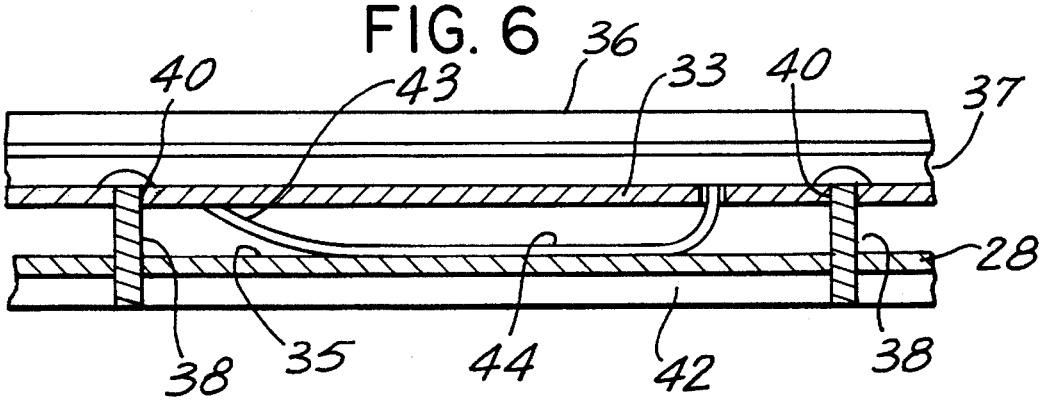
FIG. 6 is a sectional view taken along line 6—6 of FIG. 2.

Bar or housing member 37 is resiliently mounted within channel 28. As seen in FIG. 6, this is accomplished by a plurality of screws 38 which pass through unthreaded opening 40 in the bar and are threaded in turn in to the base element 42 of channel 28. A curved leaf spring 44 is secured at one end in a slot 41 in base 33 of bar 37 with its free end 43 bearing against base 33. The spring also bears against the surface 35 of channel 28 to bias bar 37 outwardly.

The second seal means 24 is of similar construction. It includes a housing or channel member 50 mounted in a groove 52 formed in the edge 11 of door 10. Channel 50 includes an outwardly opening channel 54 formed therein.

Channel 50 is mounted in groove 52 by a plurality of screws 32, in the same way as previously described with respect to housing 26. Housing or channel 50 includes a second housing 56 which is resiliently mounted within. The housing 56 is also a generally channel-shaped member having an outwardly opening channel 58 formed therein. This channel is filled with an intumescent material 60 which may be a hard puff or soft puff material as described above.

Housing 56 is spring biased away from channel 52 by a biasing arrangement similar to that previously described. This biasing arrangement includes a plurality of screws 62 whose heads are located within the channel of housing 56 and who stems pass through unthreaded openings in the channel and are threaded into the base 42 of housing 52. A flat leaf spring is located in the space 62 between housing 56 and channel 52 in the same manner as previously described in regard to FIG. 6, in order to provide an outward biasing force to housing 56.

When the seal means of FIG. 2 is installed, the first and second seal members are installed to be in facial alignment to each other. As a result, the wiper like neoprene seal member 36 will engage in the channel 56 and form a preliminary seal for the door to block smoke and gases until the intumescent material expands sufficiently to form the desired seal. Because the bar 32 and the channel or second housing 56 are resiliently mounted as described above, any vertical misalignment of the door in the frame or the two doors relative to each other (FIG. 1A) is accommodated by the device. Likewise, any non-uniform expansion of the intumescent material is also accommodated by this resilient mounting, which ensures that the two active seal members are continuously biased towards each other.

Because the intumescent material used by applicant adheres to all sides of the opening, it will also block air blown particles, soot, and toxic by-products generated by a fire. Moreover, the seal construction does not hinder opening of the sealed door if absolutely necessary. And, the reservoir capacity of the intumescent material in the channel arrangements of the invention are designed to be sufficient to reseal the joint if the door is closed again. The resilient arrangement of the sealed members as described above ensures proper resealing.

Another embodiment of the present invention is illustrated in FIG. 3. This embodiment is of similar construction to that described with respect to FIG. 2 and like parts have been identified with like numerals. In this embodiment the seal means 22', 24' include first housing members 26', 56', which are somewhat larger than the housing members of the previously described embodiments. These housings, as illustrated in FIG. 3, include auxiliary channels 70, 72 on opposite sides of the main channels 28, 54 previously described. Thus, separator walls 74 are formed between the main channels and the auxiliary channels. The auxiliary channels open outwardly, like the main channels, and contain strips of flexible intumescent material 76. This material may also be soft puff or hard puff as described above. The housings 26', 56' are dimensioned to be substantially identical, so that the auxiliary channels align with each other when the seal members are properly installed. As a result, upon heating, the intumescent materials forming the strip 76 will expand and engage each other forming an additional seal on opposite sides of the primary seals, further improving the sealing function of the device.

Figure 5:
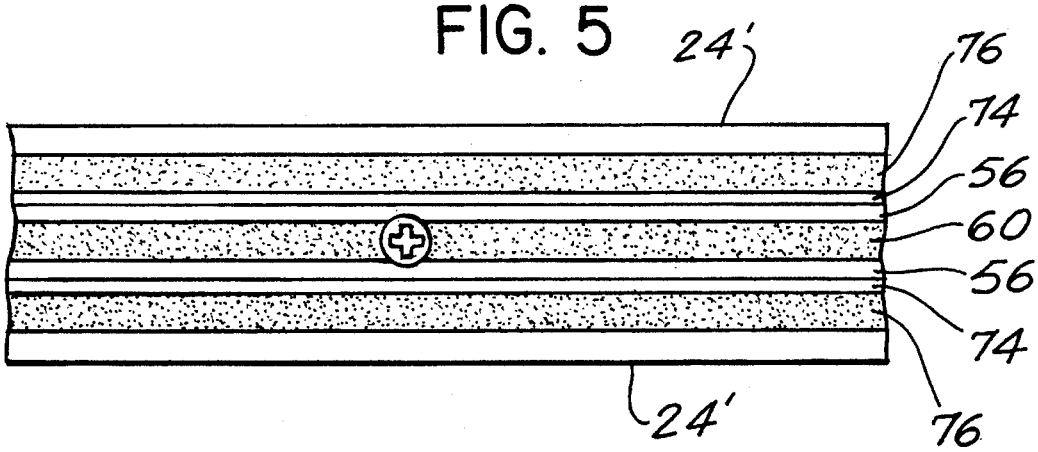
FIG. 5 is a partial plan view taken along line 5—5 of FIG. 3.
Figure 4:
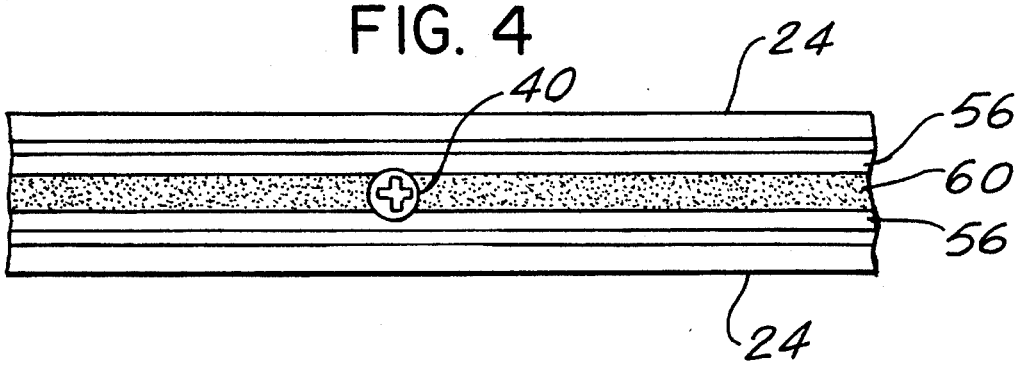
FIG. 4 is a partial plan view taken along line 4—4 of FIG. 2.

FIG. 4 is a view taken along line 4—4 of FIG. 3 showing the elevational view of the embodiment of FIG. 2. FIG. 5 is a similar elevational view taken along line 5—5 of FIG. 3.

Although illustrative embodiments of the present invention have been described herein, it is to be understood that the invention is not limited to those precise embodiments, and that various changes and modifications may be effective therein by those skilled in the art without departing from the scope of the spirit of this invention.

What is claimed is:

1. An intumescent seal comprising, a first housing having a first outwardly opening channel formed therein, a second housing adjustably and movably mounted in said first outwardly opening channel of the first housing, said second housing having an outwardly opening channel formed therein and said outwardly opening channel of the second housing being substantially filled with an intumescent material.

2. An intumescent seal as defined in claim 1 including means for resiliently mounting said second housing in said first housing, said resilient means biasing said second housing away from the first housing, and means for limiting movement of the second housing away from the first housing against the bias of said resilient means.

3. An intumescent seal as defined in claim 2 wherein said limiting means comprises means for connecting said first housing to the second housing and said resilient means comprises a spring engaged between the first and second housing, said limiting means comprising a screw having a head in said channel of the second housing and passing through an opening in the second housing whereby the second housing can move relative to the screw.

4. An intumescent seal as defined in claim 1 wherein said first housing has a pair of outwardly opening auxiliary channels located on opposite sides of the first outwardly opening channel, and intumescent material is located in said auxiliary channels.

5. An intumescent seal as defined in claim 1 wherein said seal comprises first and second seal elements adapted to be positioned in facing relation to each other, said first seal element comprising said first housing and second housing therein; said second seal element comprising a third housing having a first outwardly opening channel formed therein adapted to face the outwardly opening channel of the first housing, an elongated movably mounted support bar in said channel of the third housing, and resilient seal means mounted on said bar for engagement with the intumescent material in the second housing of the first seal element.

6. An intumescent seal as defined in claim 5 including means for resiliently mounting said bar in said third housing, means biasing said bar away from the third housing to hold the seal means against the intumescent material of the first seal means, and means for limiting movement of the bar away from the third housing against the bias of said means.

7. An intumescent seal as defined in claim 6 wherein said first housing has a pair of outwardly opening auxiliary channels located on opposite sides of the first outwardly opening channel, and intumescent material located in said auxiliary channels.

8. An intumescent seal as defined in claim 7 wherein said third housing has a pair of outwardly opening auxiliary channels located on opposite sides of the outwardly opening channel therein, and intumescent material located in said auxiliary channels.

9. An intumescent seal as defined in claim 8 wherein the auxiliary channels in said first and second seal elements are dimensioned to align with each other when the seal elements are positioned with their channels opening towards each other.

10. An intumescent seal as defined in claim 9 wherein said limiting means comprises means for connecting said first housing to the second housing and said resilient means comprises a spring engaged between the first and second housing, said screw having a head in said channel of the second housing and passing through an opening in the second housing whereby the second housing can move relative to the screw.

* * * * *